United States Patent [19]

Kano et al.

[11] Patent Number: 4,848,599

[45] Date of Patent: Jul. 18, 1989

[54] CONTAINER CLOSURE PROVIDED WITH AIR PUMP MECHANISM

[75] Inventors: Yuji Kano; Tsurusaburo Okamura, both of Chigasaki; Seiji Fukushi, Hiratsuka; Fumio Kinoshita, Niiza, all of Japan

[73] Assignee: Japan Crown Cork Co., Ltd., Tokyo, Japan

[21] Appl. No.: 146,754

[22] Filed: Jan. 22, 1988

[30] Foreign Application Priority Data

Jan. 31, 1987 [JP] Japan ..... 62-12208

[51] Int. Cl.[4] ..... B65D 83/00

[52] U.S. Cl. ..... 222/402; 222/464; 4/623

[58] Field of Search ..... 222/401, 402, 384, 464, 222/566, 180, 182, 400.8, 400.7, 400.5, 382, 52, 470, 471, 173; 4/623, 619

[56] References Cited

U.S. PATENT DOCUMENTS 2,069,383 2/1937 Nedbalek ..... 222/401

3,032,081 5/1962 Cotta ..... 222/180

*Primary Examiner*—Kevin P. Shaver

*Assistant Examiner*—Kenneth Noland

*Attorney, Agent, or Firm*—Beveridge, DeGrandi & Weilacher

[57] ABSTRACT

A closure to be applied to a container for holding a liquid such as shampoo. The closure comprises a closure body, a discharge liquid tube extending through the closure body and a reciprocating air pump mechanism built in the closure body. The air pump mechanism includes a cylinder whose discharge side communicates with the inside of the container and whose intake side communicates externally of the container, a piston, and a spring for elastically biasing the piston toward the intake side. The piston has a rod whose free end portion extends outwardly of the closure body.

3 Claims, 1 Drawing Sheet

CONTAINER CLOSURE PROVIDED WITH AIR PUMP MECHANISM

FIELD OF THE INVENTION

This invention relates to a container closure provided with a liquid discharging air pump mechanism, which is to be applied to containers for holding liquids.

DESCRIPTION OF THE PRIOR ART

It is well known that closures for containers holding liquids such as a shampoo have been in widespread use which permit liquid discharge from the containers without being detached from their mouth-neck portions.

A first type of such container closures is equipped with discharge nozzle means including a valve. This first type can be applied to a container at least the main portion of which is formed of a flexible material capable of being easily pressed out of shape. In use, the container is held by one hand and its main portion is pressed out of shape to increase the pressure of its inside. Consequently, the valve is opened to discharge the liquid through the discharge nozzle means. The discharged liquid can be received by the other hand.

A second type of such container closures is equipped with an externally operable air pump. When the liquid is to be discharged from a container on which the second-type container closure is mounted, the air pump mechanism is operated by one hand to feed air into the container and to increase the pressure in its inside. The liquid is thus discharged through a suitable discharge passage and can be received by the other hand.

The first-type container closure can be the other hand. only to those containers at least the main portion of being easily pressed out of shape. It cannot be applied to containers which are made entirely of a rigid material such as glass. The second-type conventional container closure, on the other hand, has the disadvantage that its structure is relatively complex and the cost of its production is high. Moveover, when it is necessary to receive the discharged liquid by one hand in both of the first-type and second-type closures, the container must be pressed out of shape, or the air pump must be operated, by the other hand. Accordingly, both hands have to be used in discharging and receiving the liquid.

SUMMARY OF THE INVENTION

It is a primary object of this invention to provide a novel and improved container closure of the type which permits discharging of a liquid from a container having the closure mounted thereon without the need to remove it from its mouth-neck portion. This container closure is applicable not only to containers at least the main portions of which are formed from a flexible material capable of being easily pressed out of shape, but also to containers formed entirely of a rigid material such as glass. It has a relatively simple structure and can be produced at a low cost.

Another object of this invention is to provide a novel and improved container closure which permits one hand performing the liquid discharging operation to receive the discharged liquid as well.

According to this invention, there is provided a container closure comprising a closure body adapted to be mounted on the mouth-neck portion of a container for holding a liquid, a liquid discharging tube extending from its suction end located within the container to its discharge end located outside the container via the closure body and a reciprocating air pump mechanism built in the closure body, said air pump mechanism including a piston having a cylinder whose discharge side communicates with the inside of the container and whose intake side communicates externally of the container and a rod whose free end portion extends externally of the closure body and spring means for biasing the piston elastically toward the intake side, whereby when the piston is moved toward the discharge side by pressing the free end portion of the rod against the elastic biasing action of the spring means, air is forcibly fed into the container from the air pump mechanism and the liquid in the container is discharged through the liquid discharge pump.

Preferably, in the air pump mechanism, the free end portion of the rod extends upwardly from the closure body, and the discharge end of the liquid discharge pipe is positioned upwardly of, and apart from, the free end portion of the rod. With the closure of this structure, the free end portion of the rod in the air pump mechanism can be pressed by the back of one hand and the liquid discharged from the discharge end of the liquid discharge tube can be received by its palm.

DETAILED DESCRIPTION OF PREFERRED EMBODIMENTS

Preferred embodiments of the container closure constructed in accordance with this invention will now be described in detail with reference to the accompanying drawings.

Figure 1:
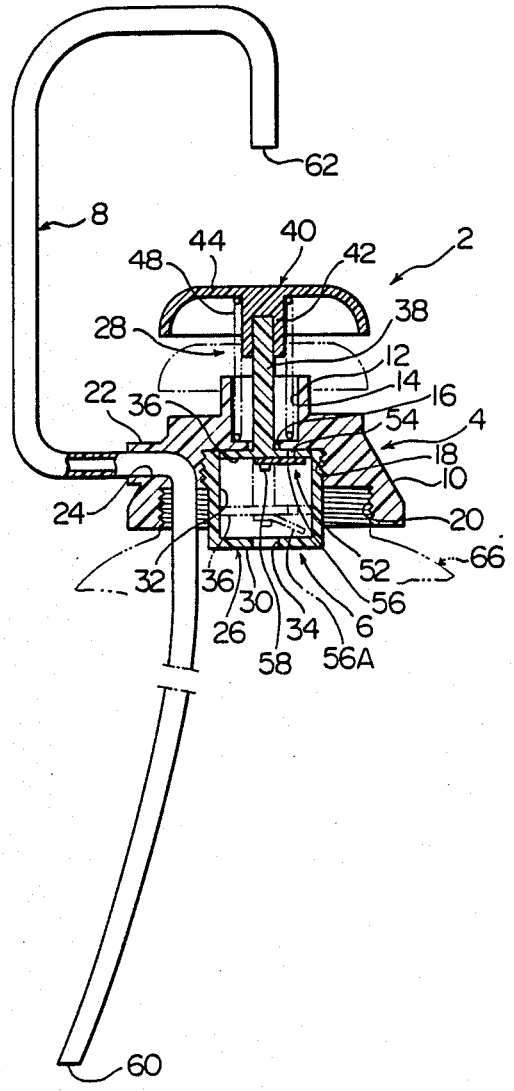
FIG. 1 is a sectional view showing one embodiment of the container closure constructed in accordance with this invention.

With reference to FIG. 1, the container closure shown generally by numeral 2 is provided with a closure body 4, an air pump mechanism 6 and a liquid discharge tube 8.

The closure body 4 may be formed from a suitable synthetic resin and has a main portion 10 nearly in the shape of a truncated cone and a cylindrical projecting portion 12 extending upwardly from the upper surface of the main portion 10. A hole is formed extending axially through the central portion of the closure body 4. The hole is composed of a medium-diameter upper portion 14, a small-diameter portion 16, a medium-diameter portion 18 and a large-diameter lower portion 20 positioned in this order from top to bottom. An internal thread is formed in the inner circumferential surface of the large-diameter lower portion 20. An internal thread is also formed in the inner circumferential surface of the medium-diameter portion 18. A cylindrical protrusion 22 protruding radially outwardly is formed at a specific angular site on the outer circumferential surface of the closure body 4. A hole 24 extending in a nearly L-shape is formed extending from a specific angular site of the annular upper end surface of the large-diameter lower portion 20 which corresponds to the specified angular site at which the cylindrical protrusion 22 is formed to the forward end surface of the cylindrical protrusion 22. The hole 24 may have a circular cross-sectional shape.

The air pump mechanism 6 built in the closure body 4 is of the reciprocating type including a cylinder 26 and a piston 28. The cylinder 26 may be made of a synthetic resin, and has a circular lower end wall 30 and a cylindrical side wall 32. The upper end (the intake side end) of the cylinder 26 is open. An external thread is formed on the upper outer circumferential surface of the side wall 32 of the cylinder 26. By fitting the external thread into the internal thread formed on the inner circumferential surface of the medium-diameter portion 18 of the hole, the cylinder 26 is mounted in position on the closure body 4. If desired, the cylinder 26 may be mounted on the closure body 4 by another suitable method, for example, by engagement of an engaging projection with an engaging depression. A discharge hole 34 which may be circular is formed in the central portion of the upper end wall 30 defining the discharge side end of the cylinder 26. The piston 28 may be made of a synthetic resin, and has a main body 36 in the form of a circular plate and a rod 38 extending upwardly from the main body 36. The main body 36 of the piston 28 has an outside diameter corresponding to the inside diameter of the cylinder 26, and is slidably combined with the inside of the cylinder 26. The rod 38 of the piston 38 extends downwardly through the small-diameter portion 16 and the medium-diameter upper portion 14 of the hole, and in an ordinary conditions (i.e., the condition in which the piston 28 is positioned uppermost as shown by a solid line in FIG. 1), the free end portion of the rod 38 extends upwardly a considerable amount beyond the upper end of the closure body 4. Preferably, a press member 40 is disposed in the free end portion of the rod 38. The press member 40 has a boss portion 42 to be fixed to the free end portion of the rod 38 by bonding or otherwise and a press portion 44 of an inverted dish shape. Spring means 48, which may be a compression coil spring, is disposed between the annular lower end surface of the medium-diameter upper portion 14 of the hole in the main body 4 and the press member 40. The spring means 48 elastically biases the piston 28 upwardly (i.e., toward the intake side) and elastically holds it at the uppermost position at which the main body 36 of the piston 28 abuts with the annular upper end surface of the medium-diameter portion 18 of the hole in the closure body 4, as shown by a solid line in FIG. 1.

Valve means 52 is further provided in the piston 28. The valve means 52 is formed of a communication hole 54 formed in the peripheral edge portion of the main body 36 of the piston 28 and a closing member 56 which may be rectangular. One end portion of the closing member 56 which can be formed from a flexible synthetic resin sheet is fixed to the central portion of the main body 36 by means of an anchoring pin 58. As shown by a solid line in FIG. 1, the closing member 56 usually extends along the under surface of the main body 36 of the piston 28, and its free end portion closes the communication hole 56 which may be circular in shape. On the other hand, while the piston 28 is moved upwardly toward the intake side in the manner to be described hereinafter, the free end portion of the closing member 56 is elastically bent downwardly, as shown by a two-dot chain line 56A in FIG. 1 to open the communication hole and consequently permit communication between the discharge side and the intake side of the cylinder 26.

The liquid discharge tube 8 which may be a synthetic resin tube having a circular cross-sectional shape extends through the nearly L-shaped hole 25 formed in the closure body 4. The upstream side, i.e. the intake side, portion, of the liquid discharge tube 8 extends downwardly from the closure body 4 to the intake end 60 of the tube 8. The downstream portion, i.e. the discharge side portion, of the liquid discharge tube 8 extends from the outer circumferential surface of the closure body 4 to the nearly C-shaped discharge end 62 of the tube 8. Preferably, the downwardly directed discharge end 62 is spaced upwardly from, and located opposite to, the press member 40 disposed in the free end portion of the rod 38. In other words, the press member 40 is spaced downwardly from and positioned opposite to the discharge end 62 of the discharging tube 8. The components are so dimensioned as to receive a user's hand oriented palm-upward, between the discharge end of the tube 8 and the press member 40.

Figure 2:
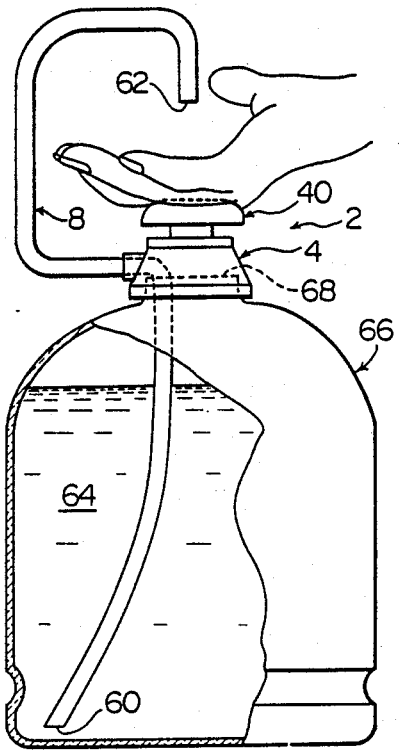
FIG. 2 is a side view, partly broken away, of the container closure of FIG. 1 as it is mounted on the mouth-neck portion of a container.

The manner of using the container closure 2 will be described with reference to FIGS. 1 and 2. The closure 2 is applied to a container 44 holding a liquid 64 such as a shampoo. The container 66 may be formed of glass or a suitable synthetic resin, and has a nearly cylindrical mouth-neck portion 68 with an open top, and an external thread is formed on the outer circumferential surface of the mouth-neck portion 68. The internal thread formed in the inner circumferential surface of the large-diameter lower portion 20 of the hole formed in the closure body 4 is screwably fitted with the external thread formed on the outer circumferential surface of the mouth-neck portion 68. As a result, the closure 2 is mounted on the mouth-neck portion 68 of the container 66 to close the mouth-neck portion 68. If desired, the closure 2 may be mounted on the mouth-neck portion 68 by another suitable means, for example by engagement of an engaging protrusion and an engaging depression. As clearly depicted in FIG. 2, The vertical axis of the container is substantially axially aligned with the press member and the piston rod. the intake side portion of the liquid discharge tube 8 extends downwardly in the liquid 64 within the container 66. In using the liquid 64 in the container 66, the press member 40 is pressed by the back of one open hand as shown in FIG. 2 to move the piston 28 of the air pump mechanism 6 downwardly (i.e., toward the discharge side) against the elastic biasing action of the spring means 48. As a result, air in the cylinder 26 is compressed and fed into the container 66 through the discharge hole 34 by the action of the main body 36 of the piston 28 moved downwardly while the valve means 52 remains closed. This will be easily understood by reference to the piston 28 shown by a two-dot chain line in FIG. 1. Consequently, the pressure in the container 66 is increased and the liquid 64 in it is discharged through the discharge tube 8. The liquid 64 discharged from the discharge end 62 of the discharge tube 8 is received by the palm of the user's hand which has its palm facing upwardly toward the tube, and its back pressing the press member 40. The liquid 64 can thus be received by only one hand without the need to use both hands. When the aforesaid one hand is withdrawn from the press member 40, the piston 38 of the air pump mechanism 6 is moved upwardly (i.e. toward the intake side) to the uppermost position shown by a solid line in FIG. 1 by the elastic biasing action of the spring means 48. As the piston 28 moves upwardly, a negative pressure is created on the discharge side to bend the closing member 56 as shown by a two-dot chain line 56A in FIG. 1 and open the communication hole 54 of the valve means 52. Hence, air is taken into the discharge side of the cylinder 26 via the intake side of the cylinder. When the piston is moved upwardly and stopped at the uppermost position, the closing member 56 elastically returns to its ordinary state to close the communication hole 54 of the valve means 52.

While the invention has been described in detail with reference to one specific embodiment of the container closure of the invention taken in conjunction with the attached drawings, it should be understood that various changes and modifications are possible without departing from the scope of the invention described and claimed herein.

What is claimed is:

1. A container closure comprising a closure body adapted to be mounted on the mouth-neck portion of a container for holding a liquid, a liquid discharging tube extending from its suction end located within the container to its discharge end located out of the container via the closure body, and a reciprocating air pump mechanism built in the closure body, said air pump mechanism including a piston having a cylinder whose discharge side communicates with the inside of the container and whose intake side communicates externally of the container, a rod whose free end portion extends upwardly externally of the closure body, and spring means for biasing the piston elastically toward the intake side, said free end portion the rod being provided with a press member which is manually depressible to move said rod and piston, said press member being spaced downwardly from and positioned opposite to the discharge end of the liquid discharging tube, said closure being so dimensioned as to receive a user's hand oriented palm-upward between the discharge end of the liquid discharging tube and the press member so that, when the piston is moved toward the discharge side by pressing the free end portion of the rod against the elastic biasing action of the spring means, air is forcibly fed into the container from the air pump mechanism and the liquid in the container is discharged through the liquid discharge tube onto a user's hand which has its palm facing upwardly toward the discharge end of the tube and its back pressing against the press member.

2. The container closure of claim 1 wherein in the main body of the piston in the air pump mechanism, valve means is provided which is adapted to be opened only when the piston is moved toward the intake side and permit communication of the intake side and the discharge side of the cylinder with each other.

3. The container closure of claim 1 mounted on a container, said container having a vertical axis which is substantially axially aligned with the press member and the piston rod.

* * * * *